US008718517B2

(12) United States Patent
Okuda

(10) Patent No.: US 8,718,517 B2
(45) Date of Patent: May 6, 2014

(54) TONER CARTRIDGE AND IMAGE FORMING APPARATUS USING THE TONER CARTRIDGE

(75) Inventor: Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 173 days.

(21) Appl. No.: 13/306,132

(22) Filed: Nov. 29, 2011

(65) Prior Publication Data

US 2012/0155925 A1 Jun. 21, 2012

(30) Foreign Application Priority Data

Dec. 17, 2010 (JP) ..... P2010-282447

(51) Int. Cl.
*G03G 15/08* (2006.01)

(52) U.S. Cl.
USPC ..... 399/260; 399/262

(58) Field of Classification Search
USPC ..... 399/260, 262, 263, 258
See application file for complete search history.

(56) References Cited

U.S. PATENT DOCUMENTS

| | | | | |
|---|---|---|---|---|
| 7,167,668 | B2 | 1/2007 | Sekiguchi | |
| 2007/0183815 | A1 * | 8/2007 | Himes | 399/262 |

FOREIGN PATENT DOCUMENTS

| | | | | |
|---|---|---|---|---|
| JP | 09134073 | A * | 5/1997 | G03G 15/08 |
| JP | 2000-315007 | | 11/2000 | |
| JP | 2001-83802 | | 3/2001 | |
| JP | 2005-227351 | | 8/2005 | |
| JP | 2008-216360 | | 9/2008 | |
| JP | 2009-233875 | | 10/2009 | |

* cited by examiner

*Primary Examiner* — Billy Lactaoen
(74) *Attorney, Agent, or Firm* — Nixon & Vanderhye, P.C.

(57) ABSTRACT

A toner cartridge that makes it possible to prevent outflow of a large amount of toners at any other time but supplying of a toner, and an image forming apparatus are provided. A toner cartridge includes a container having an outlet; a conveyance member for conveying a toner inside the container toward the outlet by rotation motion of a conveyance blade associated with rotation of a conveyance shaft; and an opening/closing member disposed so as to have a distance from an inner wall of the container, the opening/closing member being fixed to the conveyance shaft and opening or closing at least a part of the outlet in conjunction with the rotation of the conveyance shaft.

4 Claims, 11 Drawing Sheets

TONER CARTRIDGE AND IMAGE FORMING APPARATUS USING THE TONER CARTRIDGE

CROSS-REFERENCE TO RELATED APPLICATION

This application claims priority to Japanese Patent Application No. 2010-282447, which was filed on Dec. 17, 2010, the contents of which are incorporated herein by reference in its entirety.

BACKGROUND OF THE TECHNOLOGY

1. Field of the Technology

The present technology relates to a toner cartridge and an image forming apparatus.

2. Description of the Related Art

An image forming apparatus installed in a printer, a copier or the like uses a toner that is reserved in a developing device in the image forming apparatus to form an image. In a field of such an image forming apparatus, a toner cartridge is conventionally known for supplying a toner to a developing device. The toner cartridge supplies, when a toner in the developing device is consumed to be reduced, a toner in the toner cartridge into the developing device.

For example, Japanese Unexamined Patent Publication JP-A 2001-83802 and Japanese Unexamined Patent Publication JP-A 2008-216360 describe a toner cartridge including a container with an outlet and an auger screw-like conveyance member. With such a toner cartridge, a toner in the container is conveyed toward the outlet by the conveyance member so that the toner is dropped off via the outlet, then the toner is supplied into a developing device.

In the toner cartridge using the auger screw-like conveyance member as described in JP-A 2001-83802 and JP-A 2008-216360, a toner is retained near an outlet at the time of stoppage of the conveyance member. Accordingly, when some sort of vibration is applied to the toner cartridge, there is a problem such that a phenomenon that a large amount of toners suddenly flow out of the toner cartridge to be supplied into a developing device even at the time of stoppage of the conveyance member, or a so-called toner avalanche, occurs.

To approach such a problem, it is considered that a flexible film is attached to a conveyance member to close an outlet with this film at the time of stoppage of the conveyance member. However, in the case of such a configuration, there is a possibility that friction is generated between the film and an inner wall of a container to generate friction heat, which causes an adverse effect on a toner.

SUMMARY OF THE TECHNOLOGY

The technology is to solve the above-described problem and an object thereof is to provide a toner cartridge that makes it possible to suppress outflow of a large amount of toners at any other time but supplying of a toner, and an image forming apparatus.

The technology provides a toner cartridge including:

a container for containing a toner, having an outlet for discharging a toner therein;

a conveyance member disposed in the container, the conveyance member including a conveyance shaft and a conveyance blade, and conveying a toner in the container toward the outlet by rotation motion of the conveyance blade associated with rotation of the conveyance shaft; and an opening/closing member disposed so as to have a distance from an inner wall of the container, the opening/closing member being fixed to the conveyance shaft and opening or closing at least part of the outlet in conjunction with the rotation of the conveyance shaft, the opening/closing member including:

a sectorial trapezoid section having a sectorial trapezoidal flat plane perpendicular to a direction of toner conveyance by the conveyance member, in which an inner circumferential section is fixed to the conveyance shaft and a length of a chord is greater or equal to a length of an opening width of the outlet that is perpendicular to the direction of toner conveyance; and a drop inhibition section for inhibiting a toner from dropping to the outlet at a downstream position in the direction of toner conveyance from the sectorial trapezoid section and a vertically upper position from the outlet, at least a part of the outlet becoming in a closed state during a period from a time when a downstream edge in a rotational direction of the conveyance shaft of the sectorial trapezoid section is located on a vertically upper side of a downstream edge of the outlet in the rotational direction to a time when an upstream edge in the rotational direction of the sectorial trapezoid section is located on a vertically upper side of an upstream edge of the outlet in the rotational direction.

The opening/closing member opens or closes at least a part of an outlet in conjunction with rotation of a conveyance shaft. Therefore, at any other time but supplying of a toner, it is possible to make at least a part of the outlet to be in a closed state with the opening/closing member. Accordingly, it is possible to provide a toner cartridge that makes it possible to suppress outflow of a large amount of toners at any other time but supplying of a toner.

Further, in the toner cartridge according to the technology, the opening/closing member opens or closes at least a part of the outlet in a state of having a distance from an inner wall of a container. Therefore, friction is not generated between the opening/closing member and the inner wall of the container, and there is thus no possibility of causing an adverse effect on a toner by friction heat.

Additionally, in the toner cartridge according to the technology, opening/closing operation of the outlet with the opening/closing member is performed by rotation movement of the conveyance shaft of the conveyance member. Therefore, an additional driving source is not needed for the opening/closing operation of the outlet with the opening/closing member, and it is thus possible to suppress a toner cartridge to be made larger.

Further, opening/closing operation of the outlet is performed with the opening/closing member including a sectorial trapezoid section and the drop inhibition section, and it is thus possible to simplify a configuration of the toner cartridge.

Further, it is preferable that the toner cartridge further comprises an annular backflow inhibiting wall disposed on a downstream side in the direction of toner conveyance of the opening/closing member, the backflow inhibiting wall inhibiting at a downstream position in the direction of toner conveyance of the outlet a toner from moving in a direction opposite to the direction of toner conveyance to go to the outlet.

The toner cartridge comprises a backflow inhibiting wall for inhibiting a toner from moving in a direction opposite to the direction of toner conveyance to go to the outlet, and it is thus possible to further suppress outflow of the toner when the outlet is in a closed state with the opening/closing member.

Further, it is preferable that an opening width of the outlet that is perpendicular to the direction of toner conveyance falls in a range of 10 mm or more and 20 mm or less.

An opening width of the outlet falls in a range of 10 mm or more and 20 mm or less, and it is thus possible to surely drop a toner from the outlet when the outlet is in an opened state to surely supply the toner to a developing device.

Further, it is preferable that the sectorial trapezoid section is disposed at a distance of 2 mm or more and 4 mm or less in the direction of toner conveyance from an upstream edge of the outlet in the direction of toner conveyance.

The sectorial trapezoid section is disposed at a distance of 2 mm or more and 4 mm or less in the direction of toner conveyance from an upstream edge of the outlet in the direction of toner conveyance. Accordingly, in the direction of toner conveyance, in the outlet, a part of 2 mm to 4 mm away from the upstream edge of the outlet is in an opened state all the time. Even though the part of 2 mm to 4 mm away from the upstream edge of the outlet is in the opened state all the time, it is possible to cause a remained part to be in a closed state with the opening/closing member. Therefore, it is possible to suppress outflow of a large amount of toners at any other time but supplying of the toner.

Then, in supplying of a toner, it is possible to immediately drop a toner that is held between the sectorial trapezoid section and the conveyance blade to the part of 2 mm to 4 mm away from the upstream edge of the outlet. This makes it possible to suppress a toner to be compressed and overloaded.

The technology also provides an electrophotographic image forming apparatus including:

a developing device; and, the toner cartridge mentioned above as a toner cartridge for supplying toner to the developing device.

The toner cartridge and the developing device are disposed, so that it is possible to stabilize a toner concentration in the developing device and to stably form a favorable image over a long period of time.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
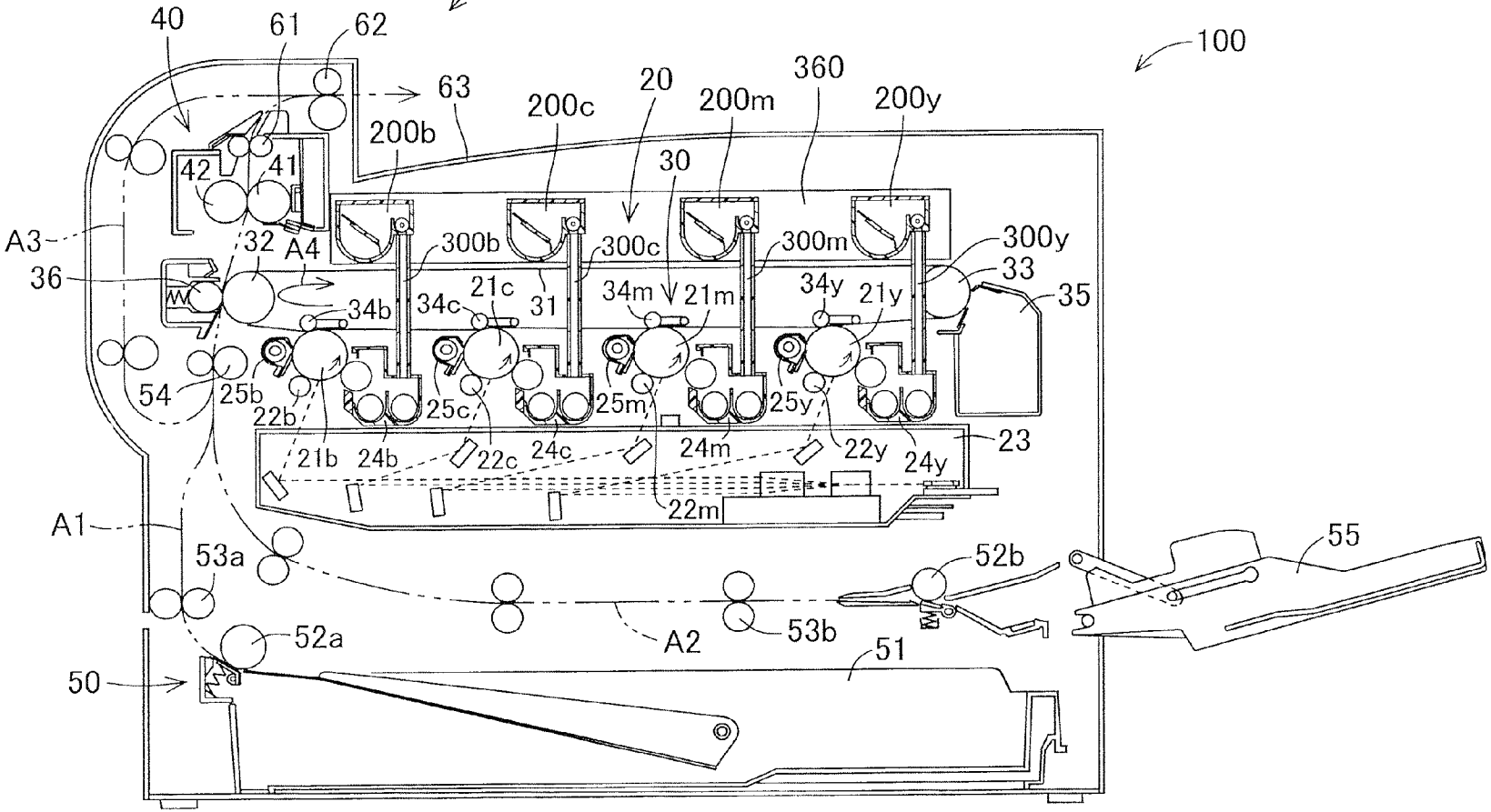
FIG. 1 is a schematic view showing a configuration of an image forming apparatus.

Now referring to the drawings, preferred embodiments are described below.

First, description will be given for an image forming apparatus 100 including a toner cartridge 200 according to an embodiment. FIG. 1 is a schematic view showing a configuration of the image forming apparatus 100.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m* and 21*y*; charging sections 22*b*, 22*c*, 22*m* and 22*y*; an exposure unit 23; developing devices 24*b*, 24*c*, 24*m* and 24*y*; cleaning units 25*b*, 25*c*, 25*m* and 25*y*; toner cartridges 200*b*, 200*c*, 200*m* and 200*y*; and toner supply pipes 300*b*, 300*c*, 300*m* and 300*y*. The toner cartridges 200*b*, 200*c*, 200*m* and 200*y* are provided as a toner cartridge unit 360. The toner cartridge unit 360 will be described below. The transfer section 30 includes an intermediate transfer belt 31, a driving roller 32, a driven roller 33, intermediate transfer rollers 34*b*, 34*c*, 34*m* and 34*y*, a transfer belt cleaning unit 35 and a transfer roller 36.

The photoreceptor drum 21, the charging section 22, the developing device 24, the cleaning unit 25, the toner cartridge 200, the toner supply pipe 300, and the intermediate transfer roller 34 are provided in four sets so as to correspond to the image information of the respective colors of black (b), cyan (c), magenta (m), and yellow (y) which are included in the color image information. In this specification, when the four sets of respective components provided for the respective colors are distinguished, letters indicating the respective colors are affixed to the end of the numbers representing the respective components, and combinations of the numbers and alphabets are used as the reference numerals. When the respective components are collectively referred, only the numerals representing the respective components are used as the reference numerals.

The photoreceptor drum 21 is supported so as to be rotatable around an axial line thereof by a driving section (not shown) and includes a conductive substrate (not shown) and a photoconductive layer (not shown) formed on a surface of the conductive substrate.

The charging section 22, the developing device 24, and the cleaning unit 25 are disposed around the photoreceptor drum 21 in that order in a rotation direction thereof. The charging section 22 is disposed vertically below the developing device 24 and the cleaning unit 25.

The charging section 22 is a device that charges a surface of the photoreceptor drum 21 so as to have predetermined polarity and potential. The charging section 22 is disposed along a longitudinal direction of the photoreceptor drum 21 so as to face the photoreceptor drum 21.

The charging section 22 is disposed around the photoreceptor drum 21 together with the developing device 24, the cleaning unit 25, and the like. The charging section 22 is preferably disposed at a position closer to the photoreceptor drum 21 than the developing device 24, the cleaning unit 25, and the like. In this way, it is possible to securely prevent the occurrence of charging faults of the photoreceptor drum 21.

As for the charging section 22, a brush-type charger, a roller-type charger, a corona discharger, an ion-generating device, or the like can be used. The brush-type charger and the roller-type charger are a charging device of contact charging type. The brush-type charger includes one which uses a charging brush, one which uses a magnetic brush, and one which uses other brushes. The corona discharger and the ion-generating device are a charging device of non-contact charging type. The corona discharger includes one which uses a wire-shaped discharge electrode, one which uses a pin-array discharge electrode, one which uses a needle-shaped discharge electrode, and one which uses other discharge electrodes.

The exposure unit 23 is disposed so that light emitted from the exposure unit 23 passes between the charging section 22 and the developing device 24 and reaches the surface of the photoreceptor drum 21. In the exposure unit 23, the charged surfaces of the photoreceptor drums 21*b*, 21*c*, 21*m*, and 21*y* are irradiated with laser beams corresponding to image information of the respective colors, whereby electrostatic latent images corresponding to the image information of the respective colors are formed on the respective surfaces of the photoreceptor drums 21*b*, 21*c*, 21*m*, and 21*y*.

The toner cartridge 200 is arranged on a vertically upper side from the developing device 24, and contains an unused toner. To a vertically lower part of the toner cartridge 200, the toner supply pipe 300 that is a cylindrical member is connected. The toner cartridge 200 supplies a toner to the developing device 24 via the toner supply pipe 300. The toner cartridge 200 will be described in detail below.

The developing device 24 is a device that develops an electrostatic latent image formed on the photoreceptor drum 21 with a toner to form a toner image on the photoreceptor drum 21. To a vertically upper part of the developing device 24, the toner supply pipe 300 is connected.

The developing device 24 includes a developer tank, a developing roller, a first conveying screw, a second conveying screw and a toner concentration detection sensor. The developer tank contains a toner in internal space thereof. Inside the developer tank, the developing roller, the first conveying screw and the second conveying screw are rotatably supported. The developer tank has an opening that is formed at a position facing the photoreceptor drum 21, and the developing roller that is disposed at an opposite position of the photoreceptor drum 21, with the opening interposed therebetween.

The developing roller is a member which is disposed closest to the photoreceptor drum 21 so as to supply toner to an electrostatic latent image on the surface of the photoreceptor drum 21. When the toner is supplied, a potential having polarity opposite to the polarity of the potential of the charged toner is applied to a surface of the developing roller as a development bias voltage (development bias). In this way, the toner on the surface of the developing roller is smoothly supplied to the electrostatic latent image. The amount of toner supplied to the electrostatic latent image (the amount of which is referred to as "toner attachment amount") can be controlled by changing the value of the development bias.

The first conveying screw is a member which faces the developing roller and supplies toner to the vicinity of the developing roller. The second conveying screw is a member which faces the first conveying screw and feeds toner which is newly supplied into the developer tank through the toner supply pipe 300 to the vicinity of the first conveying screw.

A toner concentration detection sensor is disposed on a bottom surface of the developer tank. The toner concentration detection sensor detects a toner concentration in the developer tank. As for the toner concentration detection sensor, a general toner concentration detection sensor can be used, and examples thereof include a transmission light detection sensor, a reflection light detection sensor, a permittivity detection sensor, and the like. Among these sensors, a permittivity detection sensor is preferred.

The toner concentration detection sensor is electrically connected to a toner concentration control section. In the case of judging that a toner concentration value by the toner concentration detection sensor is lower than a predetermined set value, the toner concentration control section performs control so as to rotationally drive a conveyance member 230 that is described below inside the toner cartridge 200 to supply a toner inside the toner cartridge 200 into the developer tank.

The cleaning unit 25 is a member which removes the toner which remains on the surface of the photoreceptor drum 21 after the toner image has been transferred from the photoreceptor drum 21 to the intermediate transfer belt 31, and thus cleans the surface of the photoreceptor drum 21.

According to the toner image forming section 20, the surface of the photoreceptor drum 21 which is evenly charged by the charging section 22 is irradiated with a laser beam corresponding to the image information from the exposure unit 23, whereby an electrostatic latent image is formed on the surface of the photoreceptor drum 21. The toner is supplied from the developing device 24 to the electrostatic latent image on the photoreceptor drum 21, whereby toner image is formed. The toner image is transferred to the intermediate transfer belt 31 described later. The toner which remains on the surface of the photoreceptor drum 21 after the toner image has been transferred to the intermediate transfer belt 31 is removed by the cleaning unit 25.

The intermediate transfer belt 31 is an endless belt-shaped member which is disposed vertically above the photoreceptor drum 21. The intermediate transfer belt 31 is supported around the driving roller 32 and the driven roller 33 with tension to form a loop-shaped path and is turned to run in the direction indicated by an arrow A4.

The driving roller 32 is disposed so as to be rotatable around an axial line thereof by a driving section (not shown). The intermediate transfer belt 31 is caused to turn by rotation of the driving roller 32 in the direction indicated by the arrow A4. The driven roller 33 is disposed so as to be rotatable in accordance with rotation of the driving roller 32 and generates a constant tension in the intermediate transfer belt 31 so that the intermediate transfer belt 31 does not go slack.

The intermediate transfer roller 34 is disposed so as to come into pressure-contact with the photoreceptor drum 21 with the intermediate transfer belt 31 interposed therebetween and be rotatable around an axial line thereof by a driving section (not shown). As for the intermediate transfer roller 34, one in which a conductive elastic member is formed on the surface of a roller made of metal (for example, stainless steel) having a diameter of 8 mm to 10 mm can be used, for example. The intermediate transfer roller 34 is connected to a power source (not shown) that applies a transfer bias voltage and has a function of transferring the toner images on the surface of the photoreceptor drum 21 to the intermediate transfer belt 31.

The transfer roller 36 is disposed so as to come into pressure-contact with the driving roller 32 with the intermediate transfer belt 31 interposed therebetween and be rotatable around an axial line thereof by a driving section (not shown). In a pressure-contact portion (a transfer nip region) between the transfer roller 36 and the driving roller 32, the toner images which have been borne on the intermediate transfer belt 31 and conveyed to the pressure-contact portion are transferred to a recording medium fed from the recording medium feeding section 50 described later.

The transfer belt cleaning unit 35 is disposed so as to face the driven roller 33 with the intermediate transfer belt 31 interposed therebetween and come into contact with a toner image bearing surface of the intermediate transfer belt 31. The transfer belt cleaning unit 35 is disposed so as to remove and collect the toner which remains on the surface of the intermediate transfer belt 31 after the toner images have been transferred to the recording medium.

According to the transfer section 30, when the intermediate transfer belt 31 is turned to run while making contact with the photoreceptor drum 21, a transfer bias having a polarity opposite to the polarity of the charged toner on the surface of the photoreceptor drum 21 is applied to the intermediate transfer roller 34, and the toner image formed on the surface of the photoreceptor drum 21 is transferred to the intermediate transfer belt 31. The toner images of the respective colors formed by the respective photoreceptor drums 21*y*, 21*m*, 21*c*, and 21*b* are sequentially transferred and overlaid onto the intermediates transfer belt 31, whereby a full-color toner image is formed. The toner images transferred to the intermediate transfer belt 31 are conveyed to the transfer nip region by turning movement of the intermediate transfer belt 31, and the toner images are transferred to the recording medium in the transfer nip region. The recording medium on which the toner images are transferred is conveyed to a fixing section 40 described later.

The recording medium feeding section 50 includes a paper feed box 51, pickup rollers 52*a* and 52*b*, conveying rollers 53*a* and 53*b*, registration rollers 54, and a paper feed tray 55. The paper feed box 51 is a container-shaped member which is disposed in a vertically lower part of the image forming apparatus 100 so as to store recording mediums at the inside of the image forming apparatus 100. The paper feed tray 55 is a tray-shaped member which is disposed on an outer wall surface of the image forming apparatus 100 so as to store recording mediums outside the image forming apparatus 100.

The pickup roller 52*a* is a member which takes out the recording mediums stored in the paper feed box 51 sheet by sheet and feeds the recording medium to a paper conveyance path A1. The conveying rollers 53*a* are a pair of roller-shaped members disposed so as to come into pressure-contact with each other, and convey the recording medium towards the registration rollers 54 along the paper conveyance path A1. The pickup roller 52*b* is a member which takes out the recording mediums stored in the paper feed tray 55 sheet by sheet and feeds the recording medium to a paper, conveyance path A2. The conveying rollers 53*b* are a pair of roller-shaped members disposed so as to come into pressure-contact with each other, and convey the recording medium towards the registration roller 54 along the paper conveyance path A2.

The registration rollers 54 are a pair of roller-shaped members disposed so as to come into pressure-contact with each other, and feed the recording medium fed from the conveying rollers 53*a* and 53*b* to the transfer nip region in synchronization with the conveyance of the toner images borne on the intermediate transfer belt 31 to the transfer nip region.

According to the recording medium feeding section 50, the recording medium is fed from the paper feed box 51 or the paper feed tray 55 to the transfer nip region in synchronization with the conveyance of the toner images borne on the intermediate transfer belt 31 to the transfer nip region, and the toner images are transferred to the recording medium.

The fixing section 40 includes a heating roller 41 and a pressure roller 42. The heating roller 41 is controlled so as to maintain a predetermined fixing temperature. The pressure roller 42 is a roller that comes into pressure-contact with the heating roller 41. The heating roller 41 and the pressure roller 42 pinch the recording medium under application of heat, thus fusing the toner of the toner images so as to be fixed to the recording medium. The recording medium to which the toner images have been fixed is conveyed to the discharging section 60 described later.

The discharging section 60 includes conveying rollers 61, discharge rollers 62, and a discharge tray 63. The conveying rollers 61 are a pair of roller-shaped members which is disposed vertically above the fixing section 40 so as to come into pressure-contact with each other. The conveying rollers 61 convey the recording medium on which images have been fixed towards the discharge rollers 62.

The discharge rollers 62 are a pair of roller-shaped members which is disposed so as to come into contact with each other. In the case of single-side printing, the discharge rollers 62 discharge a recording medium on which single-side printing has finished to the discharge tray 63. In the case of double-side printing, the discharge rollers 62 convey a recording medium on which single-side printing has finished to the registration rollers 54 along the paper conveyance path A3 and then discharges a recording medium on which double-side printing has finished to the discharge tray 63. The discharge tray 63 is disposed on the vertically upper surface of the image forming apparatus 100 so as to store recording mediums to which images have been fixed.

The image forming apparatus 100 includes the control unit section (not shown). The control unit section is disposed in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD).

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
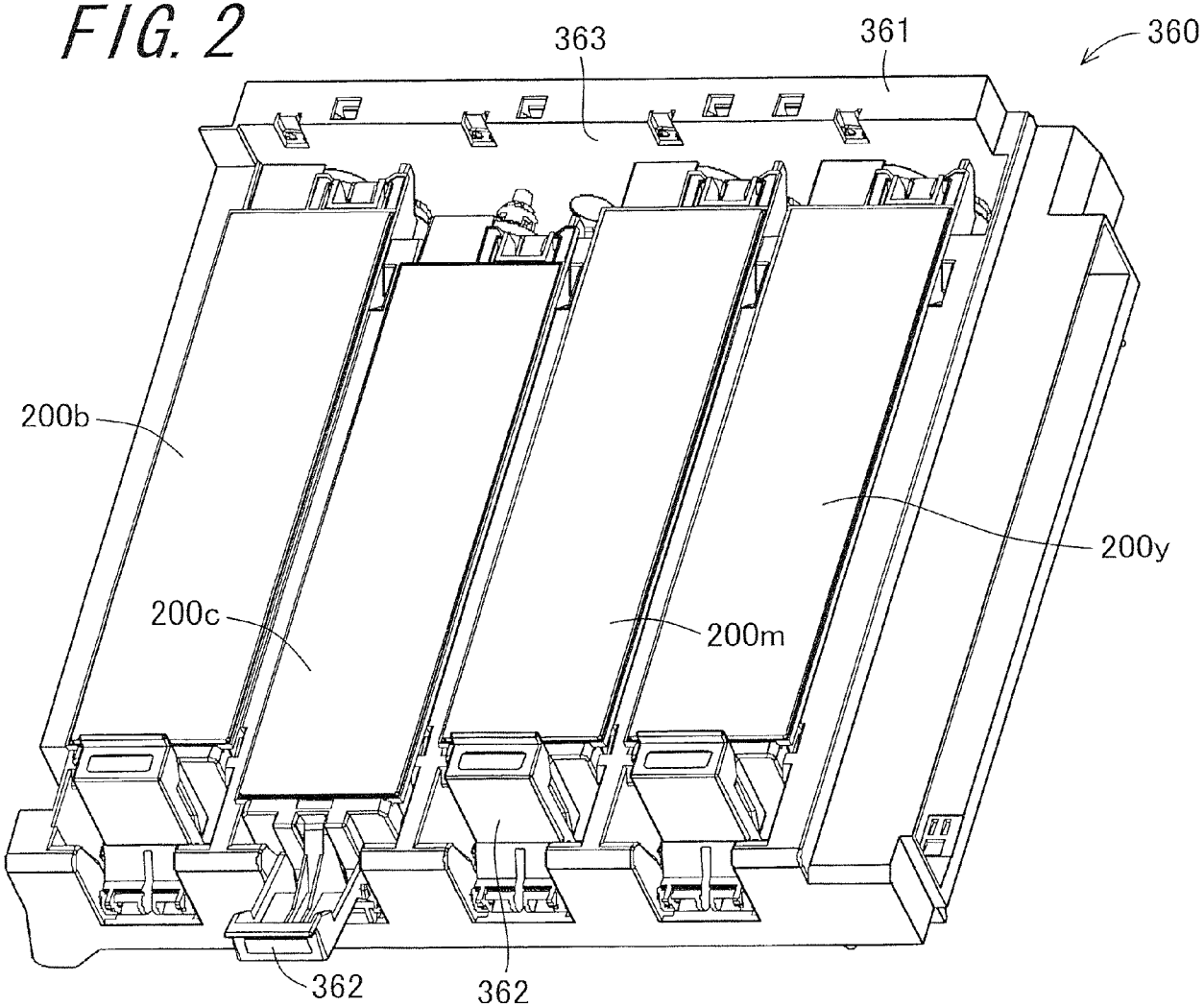
FIG. 2 is a perspective view showing a toner cartridge unit.

Next, the toner cartridge unit 360 will be described. FIG. 2 is a perspective view showing the toner cartridge unit 360. The toner cartridge unit 360 includes the toner cartridges 200*b*, 200*c*, 200*m*, and 200*y* and a toner cartridge mount 361. The toner cartridge mount 361 includes a locking lever 362 configured to be angularly displaceable and a stopper plate 363. Each toner cartridge 200 is fixed to the toner cartridge mount 361 when the locking lever 362 is angularly displaced towards the stopper plate 363 in a state of being mounted on the toner cartridge mount 361.

Figure 3:
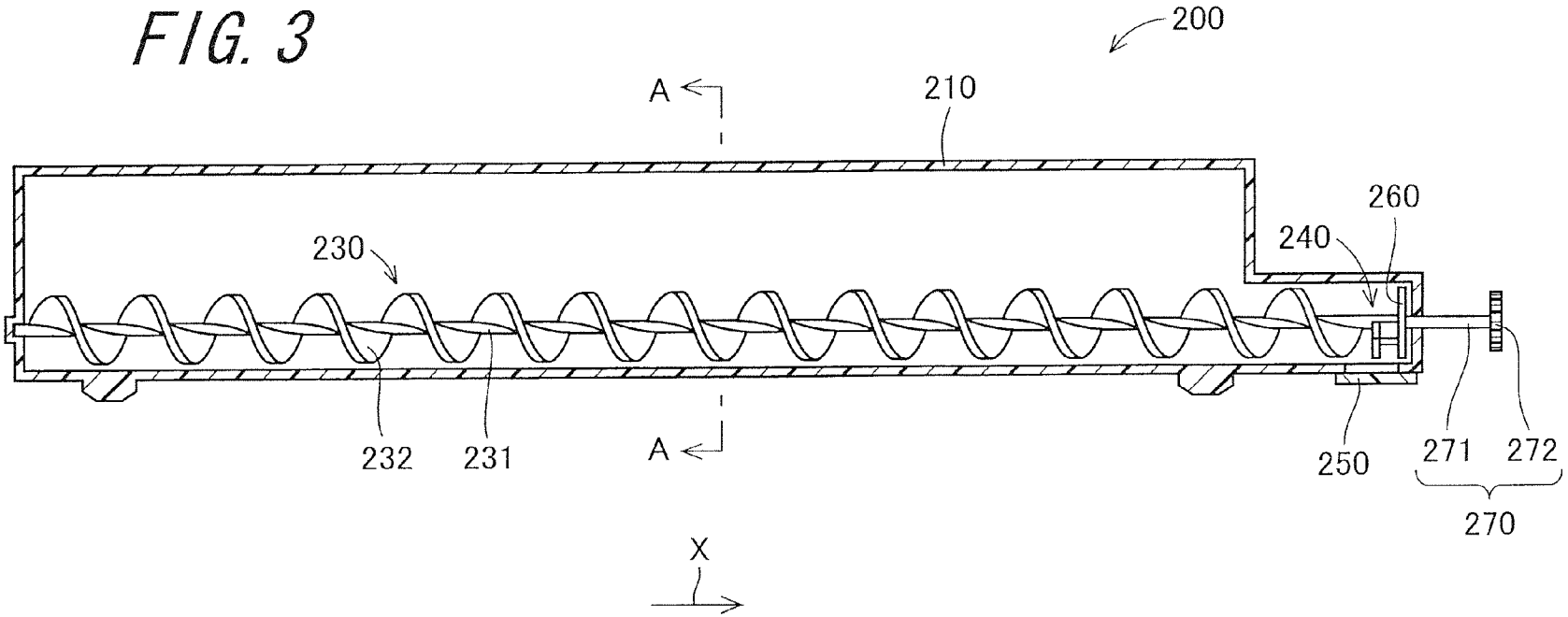
FIG. 3 is a schematic view showing an inside of a toner cartridge.
Figure 4:
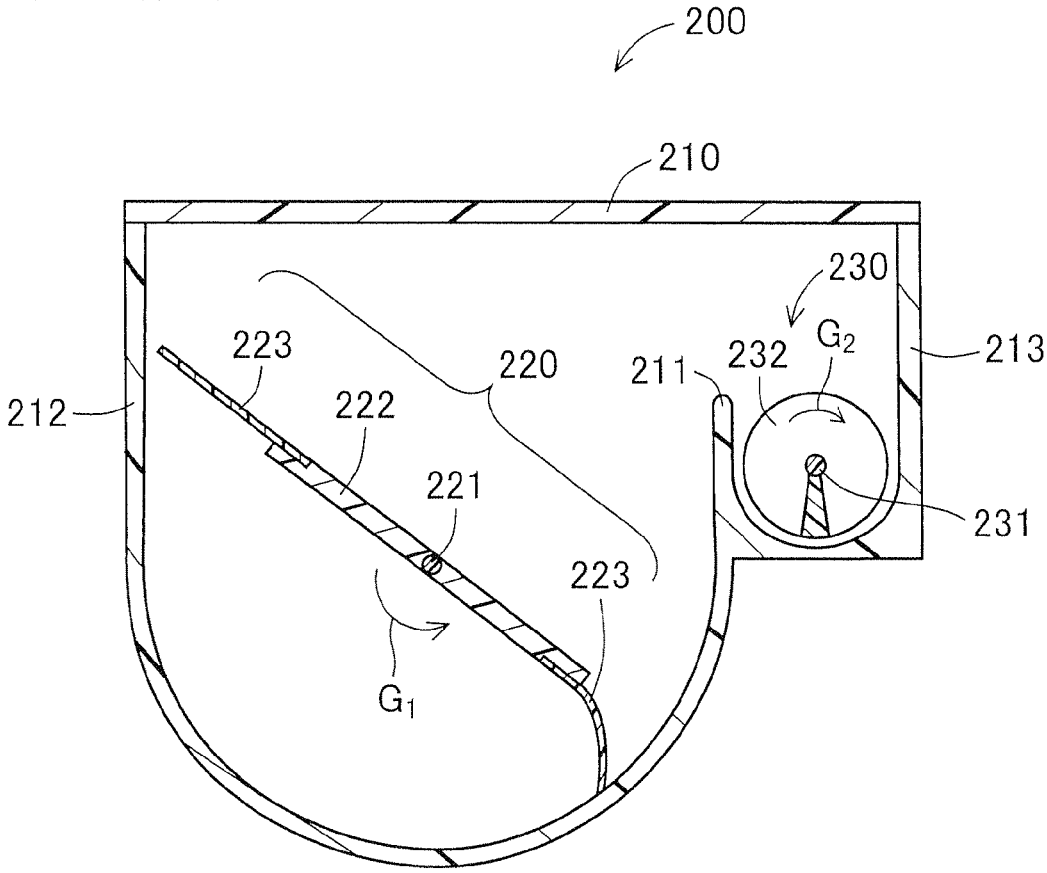
FIG. 4 is a cross-sectional view of the toner cartridge taken along the line A-A shown in FIG. 3.

Next, description will be given for the toner cartridge 200. FIG. 3 is a schematic view showing the inside of the toner cartridge 200. FIG. 4 is a cross-sectional view of the toner cartridge 200 taken along the line A-A shown in FIG. 3. The toner cartridge 200 includes a container 210, a scooping member 220, the conveyance member 230, an opening/closing member 240, a shutter member 250, a backflow inhibition wall 260 and a driving force transfer member 270, and is a device that supplies a toner to the developing device 24.

The container 210 includes a partition 211 disposed thereinside. The container 210 is partitioned by the partition 211 into a toner storing section 212 in which the scooping member 220 is disposed, and a toner discharge section 213 in which the conveyance member 230 is disposed.

The toner storing section 212 has approximately circular columnar internal space and contains a toner in the internal space, as well as has the scooping member 220 that is disposed therein.

The scooping member 220 includes a rotary shaft member 221, a base 222 and a sliding section 223. The rotary shaft member 221 is a circular columnar member that extends along an axial direction of the toner storing section 212. The base 222 is a plate-like member that extends along the axial direction of the toner storing section 212, and is installed in the rotary shaft member 221 in a central art in a width direction and a thickness direction thereof. The sliding section 223 is a flexible member that is installed at both ends in a width direction of the base 222, and is formed of, for example, polyethylene terephthalate (PET).

The scooping member 220 is connected to a driving section (not shown), and with torque imparted by the driving section, the rotary shaft member 221 rotates in a rotational direction $G_1$ around an axial line thereof. The base 222 performs rotation motion around an axial line of the rotary shaft member 221 as a center along with rotation of the rotary shaft member 221 in the rotational direction $G_1$, whereby the sliding section 223 disposed at the both ends in the width direction of the base 222 slides on an inner wall surface of the toner storing section 212 so that a toner inside the toner storing section 212 is scooped up to the toner discharge section 213.

The toner discharge section 213 has approximately circular columnar internal space, and the internal space communicates with the internal space of the toner storing section 212. The toner discharge section 213 is disposed so that an axial direction thereof becomes approximately parallel to the axial direction of the toner storing section 212. At one end in an axial direction of the toner discharge section 213, an outlet 214 that is an opening for discharging a toner is disposed. Hereinafter, a direction going from another end to one end in the axial direction of the toner discharge section 213 is referred to as a conveyance direction X.

Figure 5:
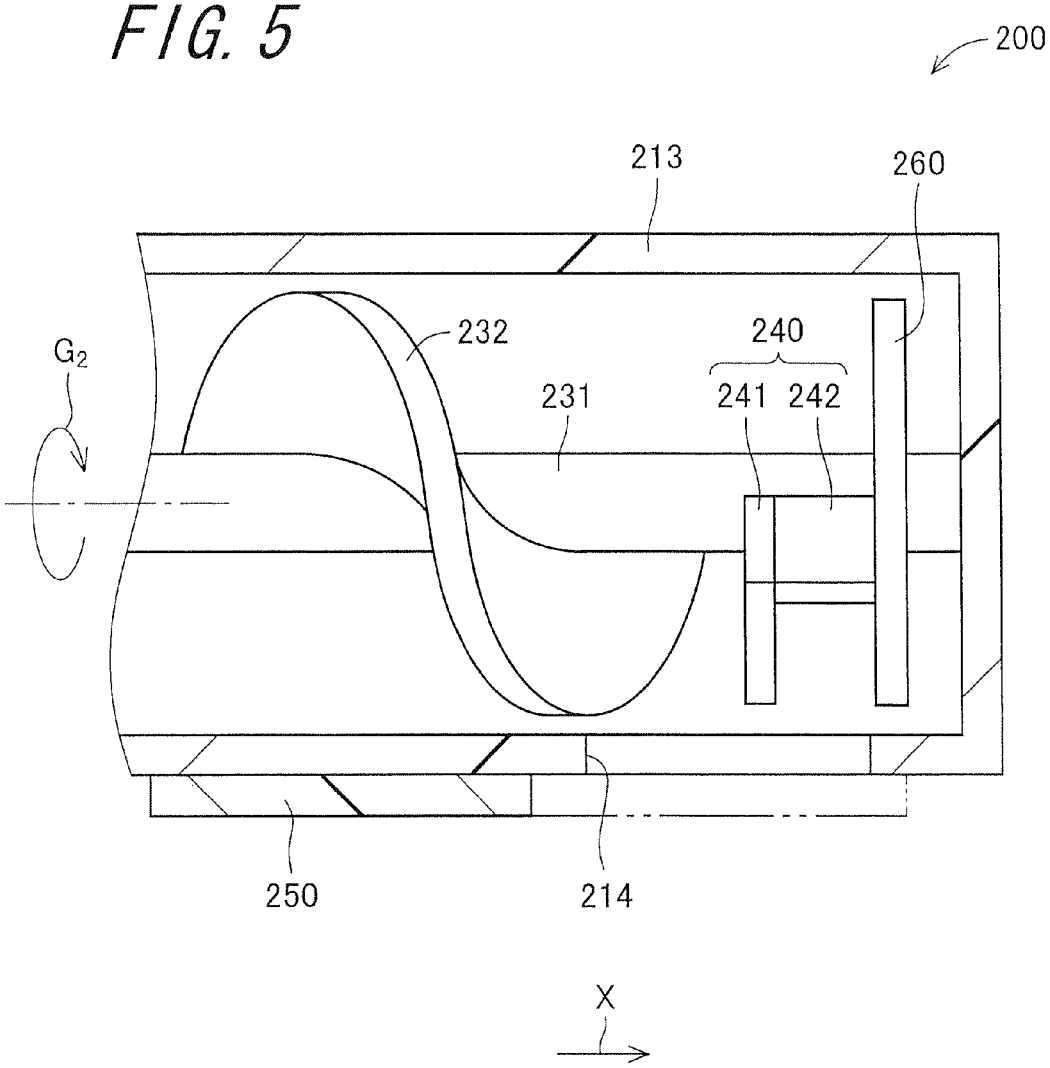
FIG. 5 is a view showing one end in an axial direction of a toner discharge section.
Figure 6:
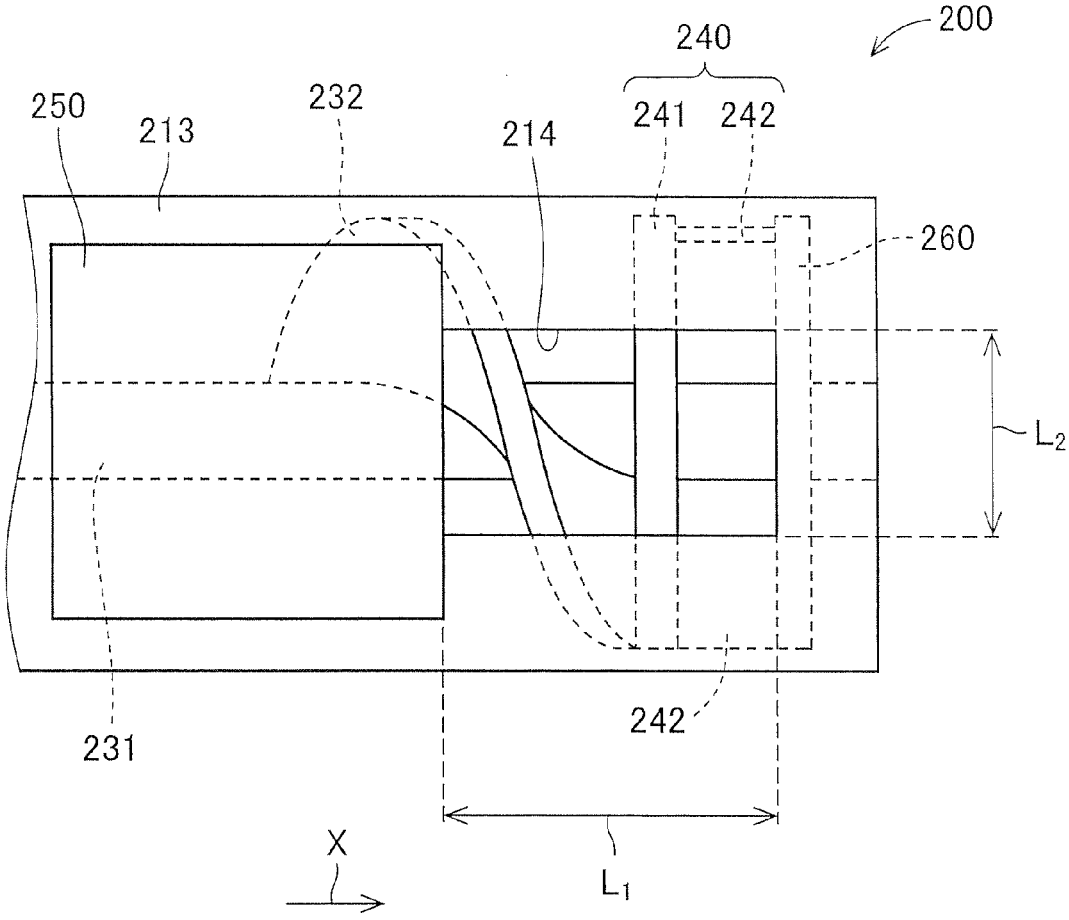
FIG. 6 is a view in the case of viewing the one end in the axial direction of the toner discharge section shown in FIG. 5 from a vertically lower side.

FIG. 5 is a view showing one end in an axial direction of the toner discharge section 213. FIG. 6 is a view in the case of viewing the one end in the axial direction of the toner discharge section 213 shown in FIG. 5 from a vertically lower side. In the embodiment, the outlet 214 is formed in a vertically lower part of the toner discharge section 213. As shown in FIG. 6, in the embodiment, the outlet 214 has an approximately rectangular shape. An opening length $L_1$ of the outlet 214 along the conveyance direction X is appropriately set in a range of 10 mm or more and 40 mm or less. An opening length $L_2$ of the outlet 214 that is perpendicular to the conveyance direction X is appropriately set in a range of 10 mm or more and 20 mm or less. A toner discharged from the outlet 214 is supplied to the developing device 24 via the toner supply pipe 300.

The shutter member 250 is slidably disposed on a vertically lower side of the outlet 214. In the process that the toner cartridge 200 is mounted to a toner cartridge mount 361, the shutter member 250 is in contact with the toner supply pipe 300 and thereby slides in an approximately horizontal direction, whereby the outlet 214 is opened. In FIGS. 5 and 6, the shutter member 250 slides and the outlet 214 is opened.

The conveyance member 230 is disposed inside the toner discharge section 213. The conveyance member 230 is an auger screw-like conveyance member including a conveyance shaft 231 and a conveyance blade 232. The conveyance blade 232 performs rotation motion along with rotation of the conveyance shaft 231 in a rotational direction $G_2$ around an axial line thereof so that a toner inside the toner discharge section 213 is conveyed to a downstream side in the conveyance direction X. Accordingly, with the toner cartridge 200, a toner scooped up into the toner discharge section 213 from inside the toner storing section 212 by the scooping member 220 is conveyed to the outlet 214 by the conveyance member 230 to drop from the outlet 214 to a vertically lower side, and supplied into the developer tank of the developing device 24 through the toner supply pipe 300.

The conveyance shaft 231 is a circular columnar member whose external diameter is 3 mm to 10 mm. The conveyance shaft 231 is connected to the driving force transfer member 270 at a downstream edge in the conveyance direction X. An axial line of the conveyance shaft 231, on a vertically upper side of a bisector dividing the outlet 214 in half in a width direction, extends parallel to this bisector. The conveyance shaft 231 is formed of, for example, a material such as polyethylene, polypropylene, high-impact polystyrene, or an ABS resin (acrylonitrile-butadiene-styrene copolymer synthetic resin).

The conveyance blade 232 is a spiral member that is disposed by surrounding the conveyance shaft 231. An external diameter of the conveyance blade 232 falls in a range of 12 mm to 25 mm. The conveyance blade 232 is formed of, for example, a material such as polyethylene, polypropylene, high-impact polystyrene, or an ABS resin, and preferably formed integrally with the conveyance shaft 231.

Figure 7:
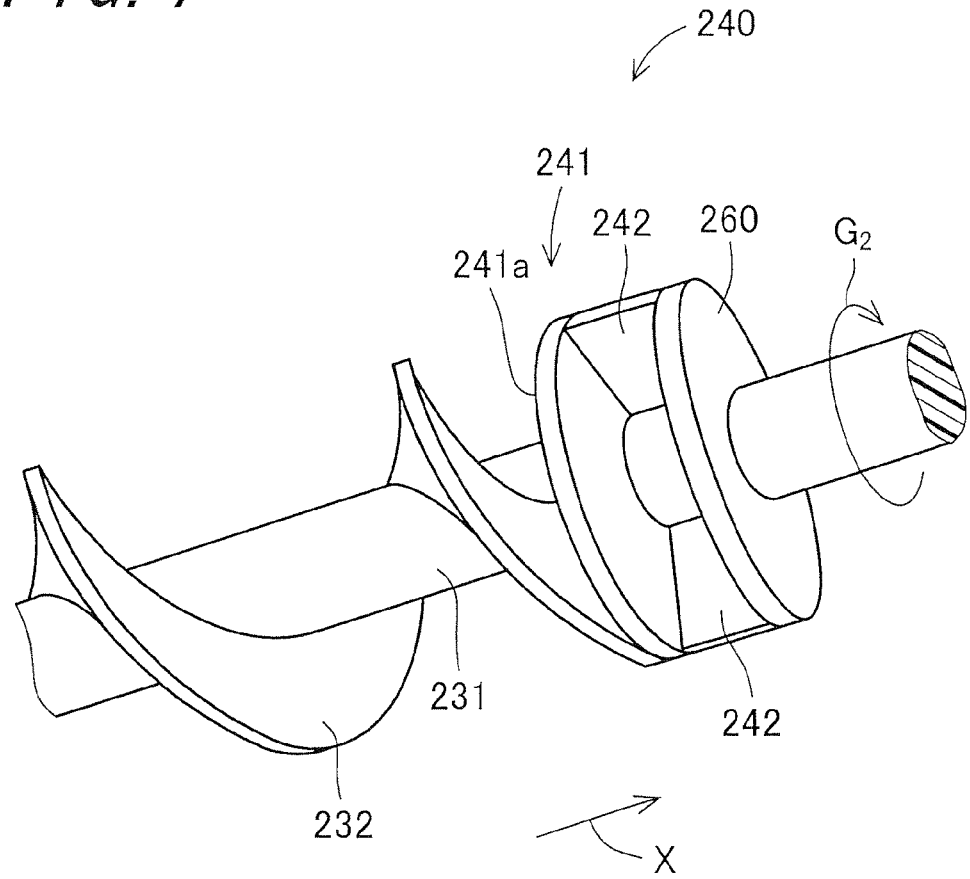
FIG. 7 is a perspective view showing a opening/closing member.

FIG. 7 is a perspective view showing the opening/closing member 240. The opening/closing member 240 includes a sectorial trapezoid section 241 having a sectorial trapezoidal flat plane 241*a* and a drop inhibition section 242.

The sectorial trapezoid section 241 is disposed on the conveyance shaft 231 on a downstream side in the conveyance direction X from the conveyance blade 232. The sectorial trapezoid section 241 is a plate-like member having the sectorial trapezoidal flat plane 241*a* on an upstream side in the conveyance direction X. The sectorial trapezoid section 241 is disposed so that the sectorial trapezoidal flat plane 241*a* becomes perpendicular to the conveyance direction X.

Figure 8:
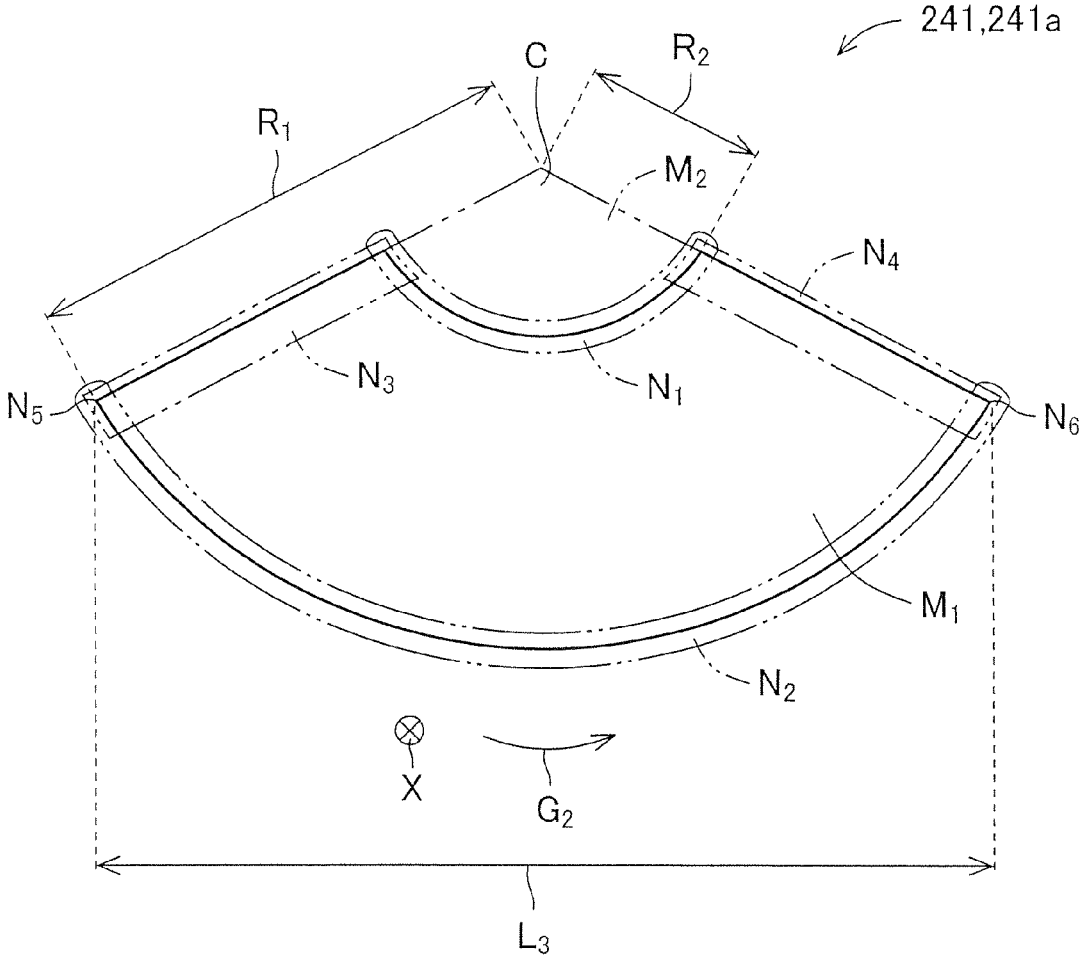
FIG. 8 is a plane view of a sectorial trapezoid section.

FIG. 8 is a plane view of the sectorial trapezoid section 241, and shows the sectorial trapezoidal flat plane 241*a*. In the embodiment, the sectorial trapezoidal flat plane 241*a* is a plane figure in which a sector $M_2$ whose central angle C is identical to as well as whose radius is smaller than that of a large sector $M_1$ is removed from this large sector $M_1$. Additionally, in the embodiment, the central angle C of the large sector $M_1$ is referred to as a central angle of the sectorial trapezoid section 241. An angle of a central angle of the sectorial trapezoid section 241 is appropriately set in a range of 90° or more and 180° or less. Moreover, in the embodiment, a value $R_1$-$R_2$ in which a radius $R_2$ of the small sector $M_2$ is subtracted from a radius $R_1$ of the large sector $M_1$ is referred to as a radius of the sectorial trapezoid section 241. The radius $R_1$ of the large sector $M_1$ nearly equals to half a value of an external diameter of the conveyance blade 232, and the radius $R_2$ of the small sector $M_2$ nearly equals to half a value of an external diameter of the conveyance shaft 231. Additionally, in the embodiment, a chord $L_3$ of the large sector $M_1$ is referred to as a chord of the sectorial trapezoid section 241. A length of the chord of the sectorial trapezoid section 241 is at least greater or equal to a length $L_2$ of the outlet 214 that is perpendicular to the conveyance direction X, and appropriately set in a range of 11 mm or more and 25 mm or less.

Further, in the embodiment, a closest part to the small sector $M_2$ on the sectorial trapezoidal flat plane 241*a* is referred to as an inner circumferential section $N_1$ of the sectorial trapezoid section 241, and a farthest part from the small sector $M_2$ on the sectorial trapezoidal flat plane 241*a* is referred to as an outer circumferential section $N_2$ of the sectorial trapezoid section 241. The inner circumferential section $N_1$ of the sectorial trapezoid section 241 is fixed to the conveyance shaft 231. An external diameter of the conveyance shaft 231 that is fixed to the inner circumferential section $N_1$ of the sectorial trapezoid section 241 is set to twice a value of the radius $R_2$ of the small sector $M_2$. The outer circumferential section $N_2$ of the sectorial trapezoid section 241 has a distance from an inner wall of the toner discharge section 213 in a range of 0.05 mm or more and 1 mm or less.

Further, in the embodiment, an upstream side end of the sectorial trapezoidal flat plane 241*a* in the rotational direction $G_2$ is referred to as an upstream side end $N_3$ of the sectorial trapezoid section 241. Further, in the embodiment, a downstream side end of the sectorial trapezoidal flat plane 241*a* in the rotational direction $G_2$ is referred to as a downstream side end $N_4$ of the sectorial trapezoid section 241. Further, in the embodiment, a part that is the upstream side end $N_3$ and the outer circumferential section $N_2$ of the sectorial trapezoid section 241 is referred to as an upstream edge $N_5$ in a rotational direction of the sectorial trapezoid section 241. Moreover, in the embodiment, a part that is the downstream side end $N_4$ and the outer circumferential section $N_2$ of the sectorial trapezoid section 241 is referred to as a downstream edge $N_6$ in the rotational direction of the sectorial trapezoid section 241.

The drop inhibition section 242 is, as shown in FIG. 7, disposed on the conveyance shaft 231 on a downstream side in the conveyance direction X from the sectorial trapezoid section 241. In the embodiment, the drop inhibition section 242 is two rectangular plate-like members each of which has a main surface extending parallel to an axial direction of the conveyance shaft 231. One of the drop inhibition section 242 has four side surfaces one of which is fixed to a back side of the upstream side end $N_3$ of the sectorial trapezoid section 241, and one of the side surfaces orthogonal to this side surface is fixed to the conveyance shaft 231. Another drop inhibition section 242 has four side surfaces one of which is fixed to a back side of the downstream side end $N_4$ of the sectorial trapezoid section 241, and one of the side surfaces orthogonal to this side surface is fixed to the conveyance shaft 231. In two drop inhibition sections 242, a side surface opposite to the side surface fixed to the conveyance shaft 231 has a distance from an inner wall of the toner discharge section 213 in a range of 0.05 mm or more and 1 mm or less.

The opening/closing member 240 is formed of, for example, a material such as polyethylene, polypropylene, high-impact polystyrene, or an ABS resin, and preferably formed integrally with the conveyance member 230.

Figure 9B:
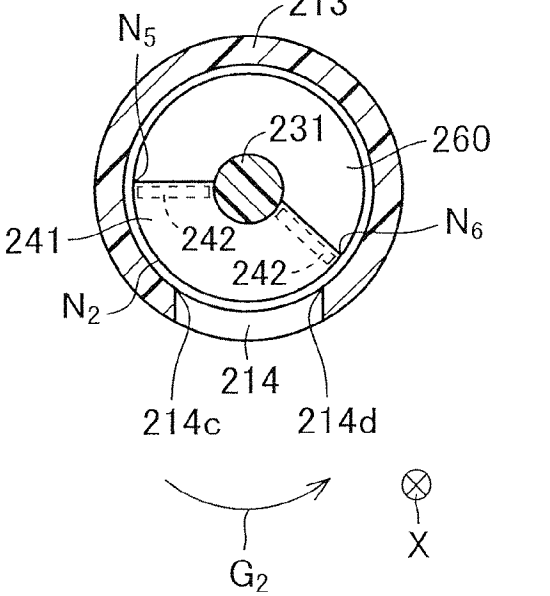
FIGS. 9A to 9F are views showing the sight of an outlet which opens and closes.
Figure 9A:
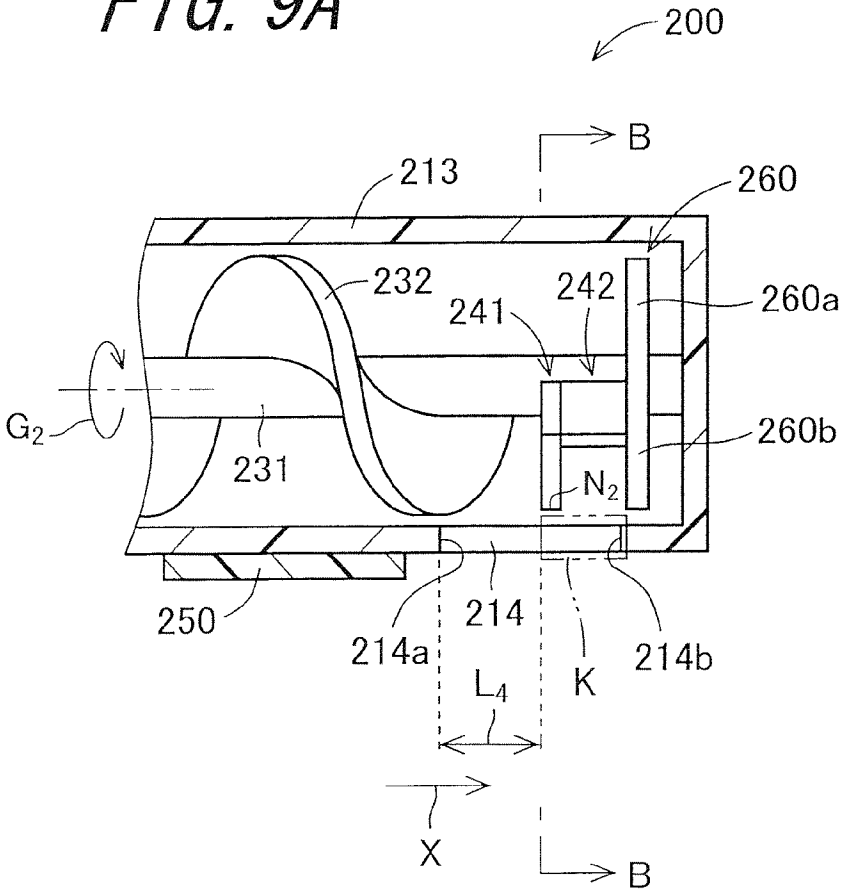
Figure 9D:
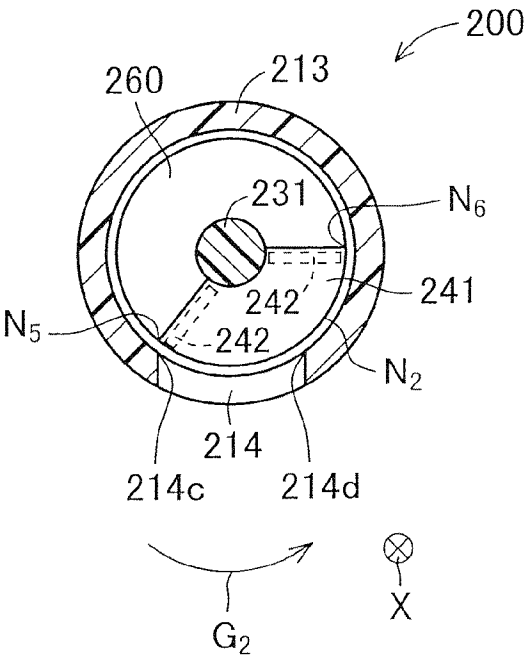
Figure 9C:
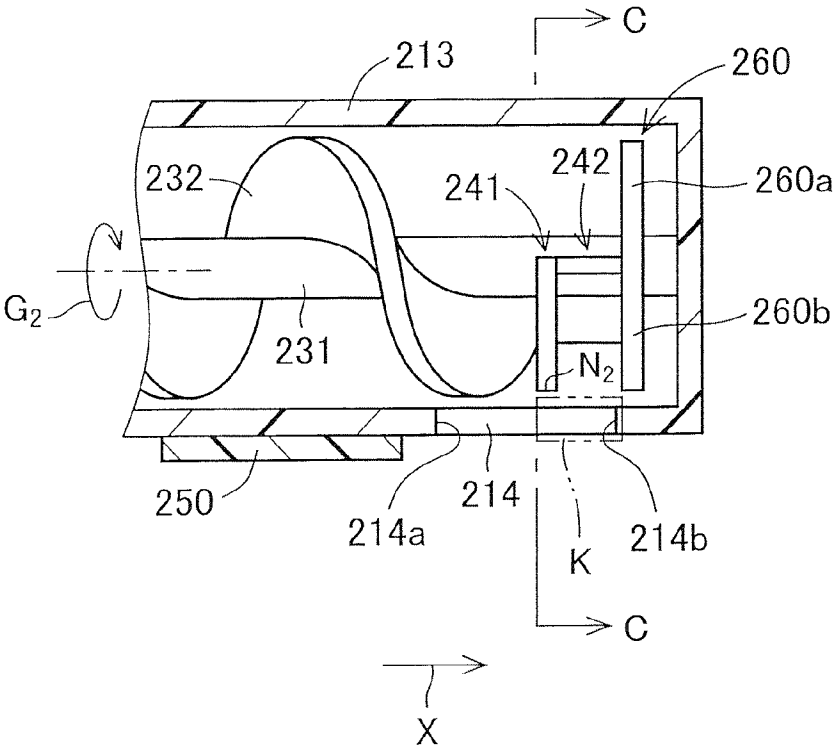
Figure 9F:
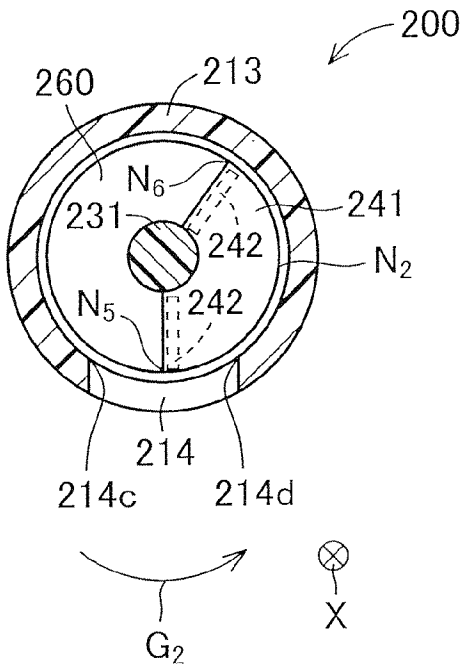
Figure 9E:
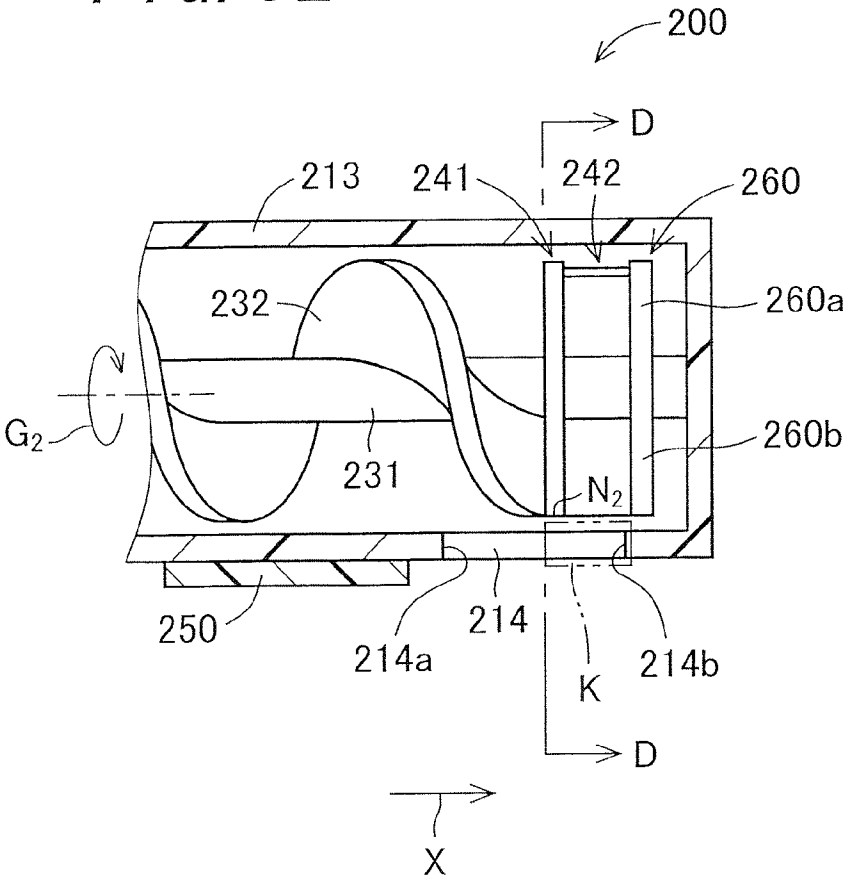

With the opening/closing member 240 including the sectorial trapezoid section 241 and the drop inhibition section 242, at least a part of the outlet 214 is opened or closed. FIGS. 9A to 9F are views showing the sight of the outlet 214 which opens and closes. FIG. 9A shows one end in an axial direction of the toner discharge section 213 in a closed state of the outlet 214, and FIG. 9B shows a cross-sectional face of the toner cartridge 200 taken along the line B-B shown in FIG. 9A. FIG. 9C shows one end in the axial direction of the toner discharge section 213 in the closed state of the outlet 214, and FIG. 9D shows a cross-sectional face of the toner cartridge 200 taken along the line C-C shown in FIG. 9C. FIG. 9E shows one end in the axial direction of the toner discharge section 213 in an opened state of the outlet 214, and FIG. 9F shows a cross-sectional face of the toner cartridge 200 taken along the line D-D shown in FIG. 9E.

As shown in FIGS. 9A and 9B, since the outer circumferential section $N_2$ of the sectorial trapezoid section 241 is close to an inner wall of the toner discharge section 213 and a clearance between the outer circumferential section $N_2$ and the inner wall of the toner discharge section 213 is 0.05 mm to 1 mm, moving of a toner inside the toner discharge section 213 to a downstream side in the conveyance direction X from the sectorial trapezoid section 241 is suppressed by the sectional trapezoid section 241. Additionally, as shown in FIG. 9A, the drop inhibition section 242 has a main surface which extends in the conveyance direction X from the sectorial trapezoid section 241 to a downstream edge 214*b* of the outlet 214 in the conveyance direction X. The drop inhibition section 242 is disposed so that dropping of a toner inside the toner discharge section to the outlet 214 is suppressed even in a case where the toner passes over the sectorial trapezoid section 241. Therefore, in a state shown in FIGS. 9A and 9B, in the outlet 214, an opening/closing part K which is a part from a vertically lower side of the sectorial trapezoid section 241 to the downstream edge 214*b* in the conveyance direction X is in a closed state with the opening/closing member 240.

In the embodiment, a distance $L_4$ in the conveyance direction X from an upstream edge 214*a* of the outlet 214 to the sectorial trapezoid section 241 in the conveyance direction X is appropriately set in a range of 2 mm or more and 4 mm or less. Therefore, in the outlet 214, in the conveyance direction X, a part which is 2 mm to 4 mm away from the upstream edge 214*a* is in an opened state all the time, and a remained part becomes the opening/closing part K for opening or closing with the opening/closing member 240. Note that, as another embodiment, all the outlet 214 may be the opening/closing part K. In this case, the sectorial trapezoid section 241 is disposed at a position on a vertically upper side of the upstream edge 214*a* of the outlet 214 or on an upstream side in the conveyance direction X from the upstream edge 214*a*.

FIGS. 9C and 9D show a state after rotation of the opening/closing member 240 in the rotational direction $G_2$ at a predetermined angle from a state shown in FIGS. 9A and 9B. Also in the state shown in FIGS. 9C and 9D, the opening/closing part K of the outlet 214 is in a closed state by the opening/closing member 240. In the state shown in FIGS. 9A and 9B, the downstream edge $N_6$ in a rotational direction of the sectorial trapezoid section 241 is located on a vertically upper side of a downstream edge 214*d* in a rotational direction of the outlet 214 as well as located at the level of the upstream edge $N_5$ or lower in the rotational direction of the sectorial trapezoid section 241 in a vertical direction, while in the state shown in FIGS. 9C and 9D, the upstream edge $N_5$ in a rotational direction of the sectorial trapezoid section 241 is located on a vertically upper side of an upstream edge 214*c* in a rotational direction of the outlet 214 as well as located at the level of the downstream edge $N_6$ or lower in a rotational direction of the sectorial trapezoid section 241 in a vertical direction.

In this manner, during a period from the time of becoming the state shown in FIGS. 9A and 9B to the time of becoming the state shown in FIGS. 9C and 9D, the opening/closing part K of the outlet 214 is in a closed state by the opening/closing member 240. While the opening/closing part K of the outlet 214 is in the closed state, outflow of a toner from the outlet 214 is suppressed.

FIGS. 9E and 9F show a state after rotation of the opening/closing member 240 in the rotational direction $G_2$ at a predetermined angle from a state shown in FIGS. 9C and 9D. In the state shown in FIGS. 9E and 9F, the opening/closing part K of the outlet 214 is a not-closed state, that is, an opened state with the opening/closing member 240. The opening/closing member 240 rotates in the rotational direction $G_2$ from the state shown in FIGS. 9E and 9F, thereby keeping the opened state for a while, thereafter becoming the closed state shown in FIGS. 9A and 9B. In this manner, the opening/closing member 240 opens or closes at least a part of the outlet 214 in conjunction with rotation of the conveyance shaft 231.

The backflow inhibition wall 260 is disposed on the conveyance shaft 231 on a downstream side in the conveyance direction X from the drop inhibition section 242, as shown in FIG. 7. The backflow inhibition wall 260 is a disc-shaped plate-like member, and into whose inner circumferential section, the conveyance shaft 231 is inserted. An internal diameter of the backflow inhibition wall 260 is nearly the same as an external diameter of the conveyance shaft 231.

The backflow inhibition wall 260 is disposed so that a main surface thereof is perpendicular to the conveyance direction X. To the main surface of the backflow inhibition wall 260 on an upstream side in the conveyance direction X, a side surface opposite to a side surface of the drop inhibition section 242 that is fixed to a back side of the sectorial trapezoid section 241 is fixed.

The backflow inhibition wall 260 is formed of, for example, a material such as polyethylene, polypropylene, high-impact polystyrene, or an ABS resin, and preferably formed integrally with the conveyance member 230.

As shown in FIGS. 9A to 9D, when the opening/closing part K of the outlet 214 is in the closed state, moving of a toner inside the toner discharge section 213 to a downstream side in the conveyance direction X is suppressed by the sectorial trapezoid section 241. There is a possibility that the toner which is prevented from moving passes over the sectorial trapezoid section 241 to move on the drop inhibition section 242 in the conveyance direction X. However, even in such a case, the backflow inhibition wall 260 prevents with a vertically upper part 260*a* thereof the toner from moving, and moving of the toner which is moving on the drop inhibition section 242, to a downstream side in the conveyance direction X from the backflow inhibition wall 260 is suppressed. When the toner moves on the downstream side in the conveyance direction X from the backflow inhibition wall 260, the backflow inhibition wall 260 prevents with a vertically lower part 260*b* thereof the toner from moving in a direction opposite to the conveyance direction X.

In this manner, the backflow inhibition wall 260 prevents a toner from moving in a direction opposite to the conveyance direction X to go to the outlet 214 at a position on a downstream side in the conveyance direction X from the outlet 214.

The driving force transfer member 270 includes a transfer shaft 271 and a gear section 272 as shown in FIG. 3. The transfer shaft 271 is a circular columnar member, whose one end is connected to the gear section 272 and another end is connected to the conveyance shaft 231. The gear section 272 engages with a gear disposed in a driving section (not shown) such as a motor, and rotates with torque imparted by the driving section. By rotation of the gear section 272, the transfer shaft 271 rotates around an axial line thereof at 30 rpm to 120 rpm. By rotation of the transfer shaft 271, the conveyance shaft 231 rotates in the rotational direction $G_2$ at 30 rpm to 120 rpm.

The driving force transfer member 270 is formed of, for example, a material such as polyethylene, polypropylene, high-impact polystyrene, or an ABS resin, and preferably formed integrally with the conveyance member 230.

In the embodiment, the gear section 272 has a position determination section (not shown) for determining a position in the rotational direction $G_2$ of the opening/closing member 240 so that the opening/closing part K of the outlet 214 becomes in a closed state. The position determination section disposed in the gear section 272 engages with a position determination section (not shown) disposed in the toner cartridge mount 361, whereby the opening/closing member 240 is, in the closed state of the opening/closing part K of the outlet 214, mounted on the toner cartridge mount 361. The toner cartridge 200 is fixed with an adhesive tape and the like so that the gear section 272 does not rotate during the period from the time of shipment until being mounted on the toner cartridge mount 361, whereby the opening/closing member 240 is fixed to a position where the opening/closing part K of the outlet 214 is in a closed state. Then, the toner cartridge 200 is mounted, at the time of use, after an adhesive tape for fixing the gear section 272 is peeled off, directly on the toner cartridge mount 361. Therefore, the toner cartridge 200 is mounted on the toner cartridge mount 361 having the opening/closing part K of the outlet 214 kept in a closed state from the time of shipment. Thereafter, when a toner is supplied to the developing device 24 by the toner cartridge 200, a rotation number of the conveyance member 230 is controlled to an integer. Thereby, at the time of stoppage of the conveyance member 230, that is, when a toner is not supplied, the opening/closing part K of the outlet 214 becomes in the closed state.

With the toner cartridge 200 constituted in this manner, the opening/closing member 240 opens or closes at least a part of the outlet 214 in conjunction with rotation of the conveyance shaft 231. Therefore, at any other time but supplying of a toner, the opening/closing member 240 enables at least a part of the outlet 214 to be in a closed state. Accordingly, the toner cartridge 200 is able to suppress outflow of a large amount of toners at any other time but supplying of a toner. This makes it possible for the image forming apparatus 100 to stabilize a toner concentration in the developing device 24 and to stably form a favorable image over a long period of time.

Further, the toner cartridge 200 opens or closes at least a part of the outlet 214 in a state where the opening/closing member 240 has a distance from an inner wall of the toner discharge section 213. Therefore, there is no friction generated between the opening/closing member 240 and the inner wall of the toner discharge section 213, and there is thus no possibility of causing an adverse effect on a toner by friction heat.

Moreover, in the toner cartridge 200, opening/closing operation of the outlet 214 with the opening/closing member 240 is performed by rotation movement of the conveyance shaft 231 of the conveyance member 230. Therefore, an additional driving source is not needed for the opening/closing operation of the outlet 214 with the opening/closing member 240, and it is thus possible to suppress a toner cartridge 200 to be made larger.

Additionally, in the embodiment, opening/closing operation of the outlet 214 is performed with the opening/closing member 240 including the sectorial trapezoid section 241 and the drop inhibition section 242. Therefore, it is possible to simplify a configuration of the toner cartridge 200, and suppress the toner cartridge 200 to be made larger.

Further, in the embodiment, the toner cartridge 200 includes the backflow inhibition wall 260 for inhibiting a toner from moving in a direction opposite to the conveyance direction X to go to the outlet 214. Therefore, it is possible to further suppress outflow of the toner when the outlet 214 is in a closed state with the opening/closing member 240. Note that, as another embodiment, the backflow inhibition wall 260 may not be provided.

Further, in the embodiment, the opening width $L_2$ of the outlet 214 falls in a range of 10 mm or more and 20 mm or less. Thereby, it is possible to surely drop a toner from the outlet 214 when the outlet 214 is in an opened state to surely supply the toner to the developing device 24.

Further, in the embodiment, the sectorial trapezoid section 241 is disposed at a distance of 2 mm or more and 4 mm or less in the conveyance direction X from the upstream edge 214*a* of the outlet 214 in the conveyance direction X. Accordingly, in the conveyance direction X, in the outlet 214, a part having a distance of 2 mm to 4 mm from the upstream edge 214*a* of the outlet 214 is in an opened state all the time. Even though the part having a distance of 2 mm to 4 mm from the upstream edge 214*a* of the outlet 214 is in the opened state all the time, it is possible to cause a remained part to be in a closed state with the opening/closing member 240. Therefore, it is possible to suppress outflow of a large amount of toners at any other time but supplying of the toner.

Then, in supplying of a toner, it is possible to immediately drop a toner that is held between the sectorial trapezoid section 241 and the conveyance blade 232 to the part which is 2 mm to 4 mm away from the upstream edge 214*a* of the outlet 214. This makes it possible to suppress a toner to be compressed and overloaded.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner cartridge comprising:

a container for containing a toner, having an outlet for discharging a toner therein;

a conveyance member disposed in the container, the conveyance member comprising a conveyance shaft and a conveyance blade, and conveying a toner in the container toward the outlet by rotation motion of the conveyance blade associated with rotation of the conveyance shaft; and an opening/closing member disposed so as to have a distance from an inner wall of the container, the opening/closing member being fixed to the conveyance shaft and opening or closing at least part of the outlet in conjunction with the rotation of the conveyance shaft, the opening/closing member comprising:

a sectorial trapezoid section having a sectorial trapezoidal flat plane perpendicular to a direction of toner conveyance by the conveyance member, in which an inner circumferential section is fixed to the conveyance shaft and a length of a chord is greater or equal to a length of an opening width of the outlet that is perpendicular to the direction of toner conveyance; and a drop inhibition section for inhibiting a toner from dropping to the outlet at a downstream position in the direction of toner conveyance from the sectorial trapezoid section and a vertically upper position from the outlet, at least a part of the outlet becoming in a closed state during a period from a time when a downstream edge in a rotational direction of the conveyance shaft of the sectorial trapezoid section is located on a vertically upper side of a downstream edge of the outlet in the rotational direction to a time when an upstream edge in the rotational direction of the sectorial trapezoid section is located on a vertically upper side of an upstream edge of the outlet in the rotational direction, wherein the sectorial trapezoid section is disposed at a distance of 2 mm or more and 4 mm or less in the direction of toner conveyance from an upstream edge of the outlet in the direction of toner conveyance.

2. The toner cartridge of claim 1, further comprising an annular backflow inhibiting wall disposed on a downstream side in the direction of toner conveyance of the opening/closing member, the backflow inhibiting wall inhibiting at a downstream position in the direction of toner conveyance of the outlet a toner from moving in a direction opposite to the direction of toner conveyance to go to the outlet.

3. The toner cartridge of claim 1, wherein an opening width of the outlet that is perpendicular to the direction of toner conveyance falls in a range of 10 mm or more and 20 mm or less.

4. An electrophotographic image forming apparatus comprising:

a developing device; and, the toner cartridge of claim 1 as a toner cartridge for supplying toner to the developing device.

* * * * *